US006527019B2

(12) United States Patent
Laurent et al.

(10) Patent No.: US 6,527,019 B2
(45) Date of Patent: Mar. 4, 2003

(54) SEALED CONFINEMENT APPLIANCE, FOR DELIVERING A SUBSTANCE

(75) Inventors: Philippe Laurent, Oullins (FR); Jean-Pierre Grimard, Vif (FR)

(73) Assignee: Becton Dickinson France, S.A., Le Pont de Claix (FR)

( * ) Notice: Subject to any disclaimer, the term of this patent is extended or adjusted under 35 U.S.C. 154(b) by 24 days.

(21) Appl. No.: 10/004,911

(22) Filed: Dec. 5, 2001

(65) Prior Publication Data

US 2002/0040739 A1 Apr. 11, 2002

Related U.S. Application Data

(62) Division of application No. 09/582,020, filed on Oct. 2, 2000.

(51) Int. Cl.[7] ..... B65B 3/04

(52) U.S. Cl. ..... 141/100; 141/104; 141/105; 141/330; 604/411; 604/416

(58) Field of Search ..... 141/100, 104, 141/105, 324, 330; 604/82, 87, 88, 408, 410, 411, 415, 416

(56) References Cited

U.S. PATENT DOCUMENTS 4,863,454 A 9/1989 LaBove
4,932,937 A 6/1990 Gustavsson et al.
5,487,737 A 1/1996 Meyer

FOREIGN PATENT DOCUMENTS

| | | |
|---|---|---|
| DE | 9300177 | 5/1994 |
| DE | 4314090 | 11/1994 |
| EP | 0225861 | 6/1987 |
| EP | 0126718 | 11/1994 |
| WO | 8803403 | 5/1988 |
| WO | 9312002 | 6/1993 |
| WO | 9936029 | 7/1999 |

*Primary Examiner*—Charles R. Eloshway
*Assistant Examiner*—Peter deVore

(57) ABSTRACT

Leaktight confinement appliance (1), intended to cooperate with an independent receptacle (3) containing a substance (4), having its own means (8) for transfer into and/or out of the receptacle, and with an independent means (71) for delivery of a material. The appliance includes a handling chamber (2) defined by a wall (13) of flexible material substantially leaktight with respect to the external environment. A pouch is formed within the wall of the handling chamber (2) for retaining an interconnection device. The handling chamber (2) is arranged to connect at least the transfer means (8) of the receptacle (3) to the delivery means (71) through the interconnection device.

20 Claims, 5 Drawing Sheets

FIG 1
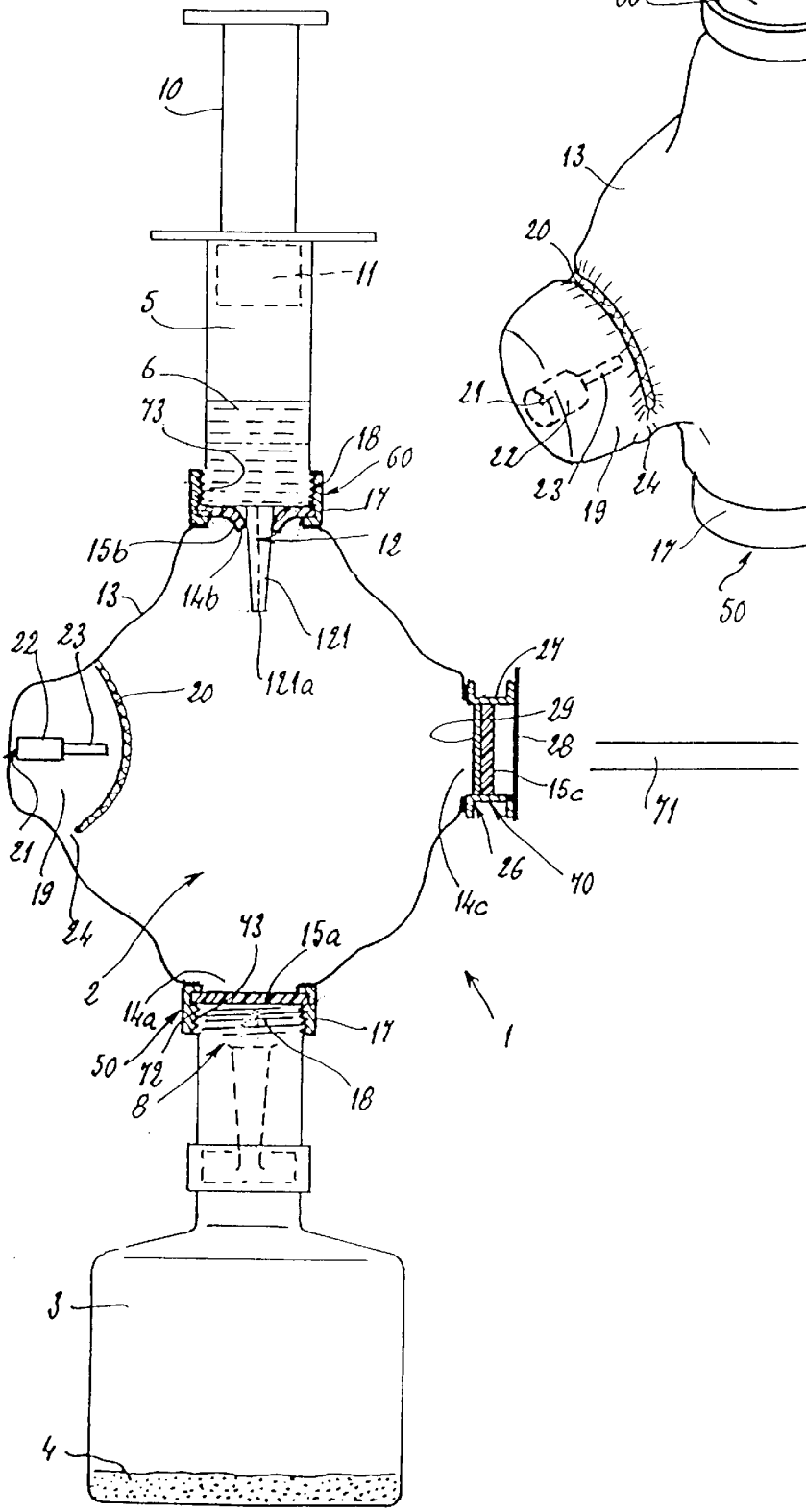
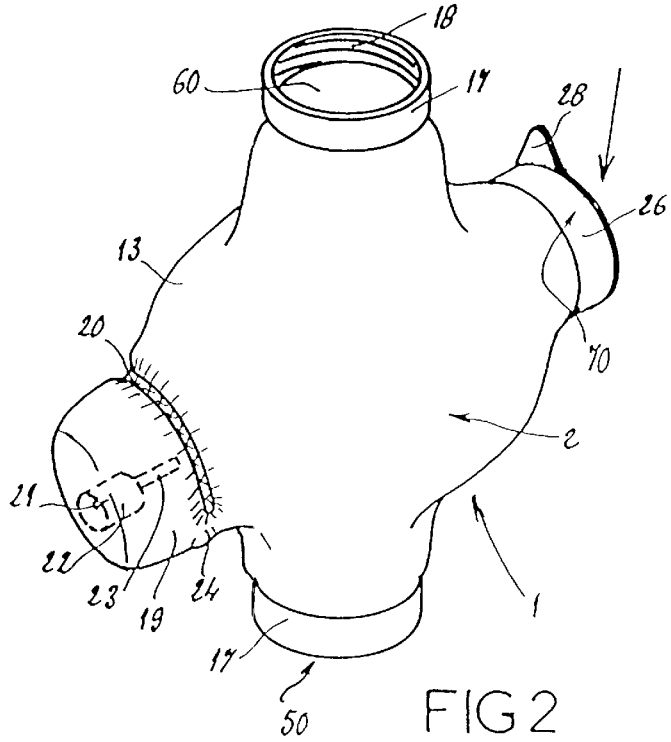
FIG 2

FIG 4
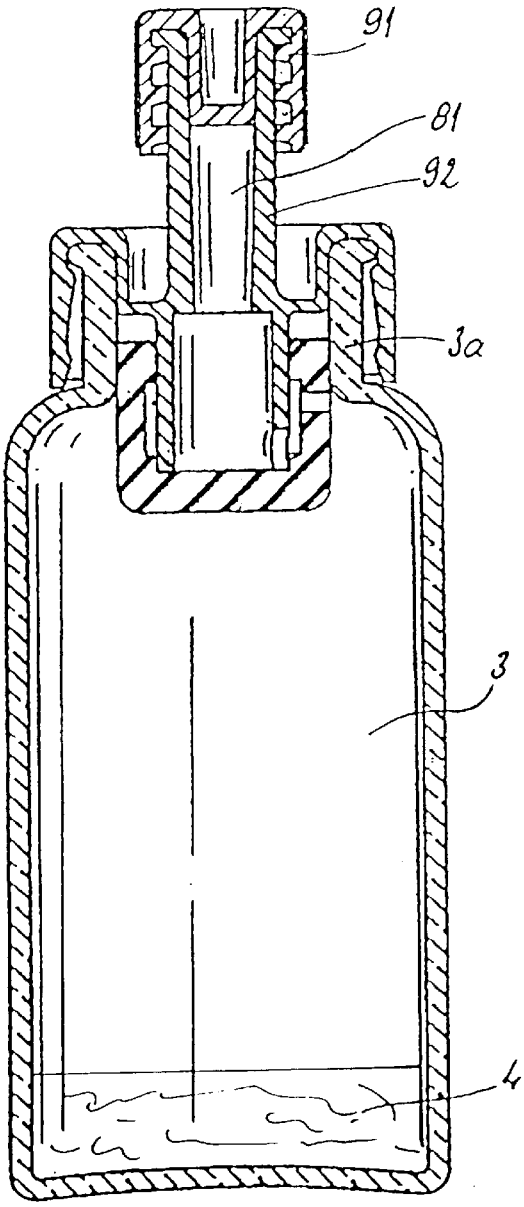
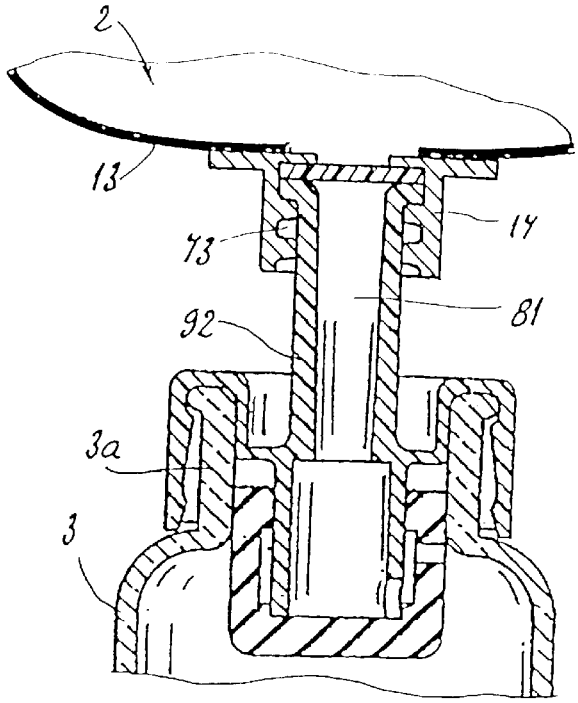
FIG 5

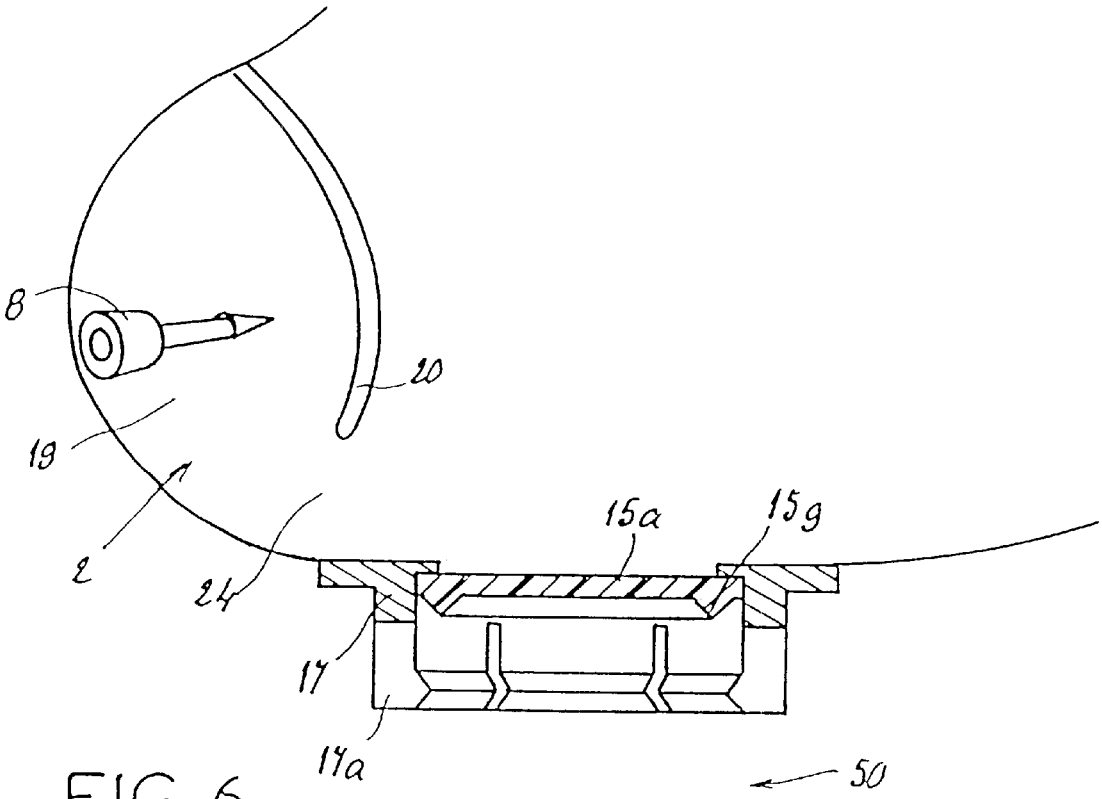
FIG 6
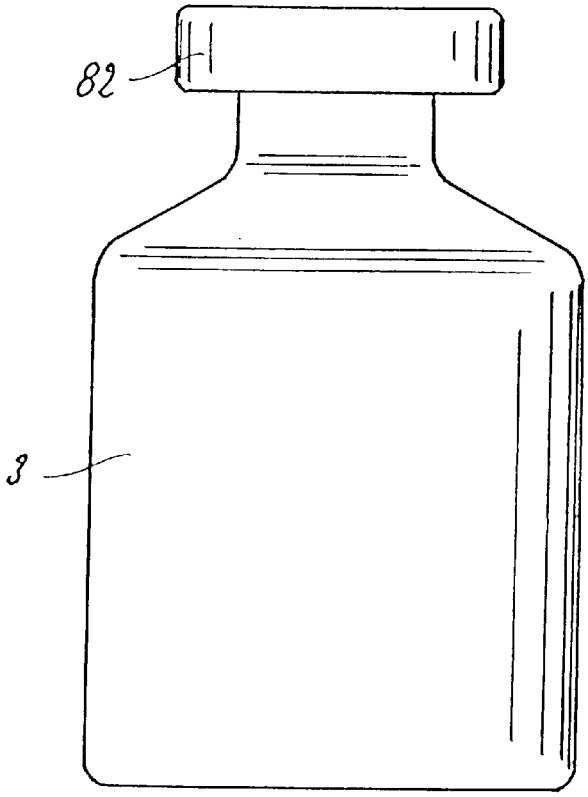

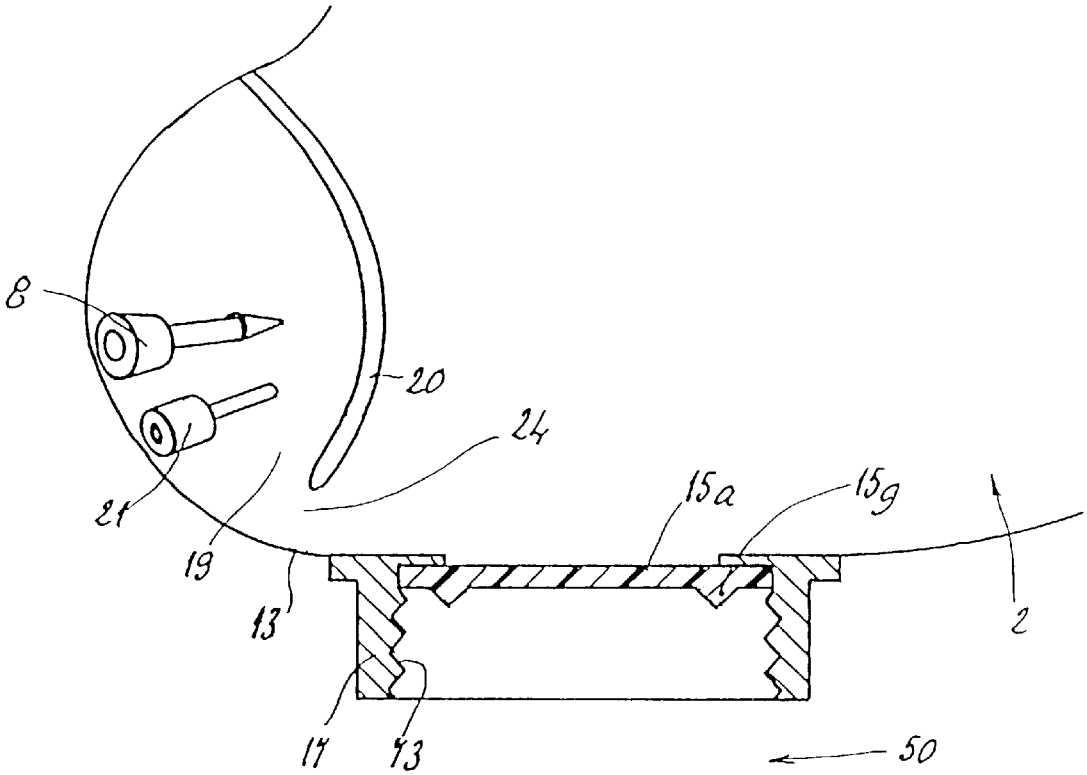
FIG 7
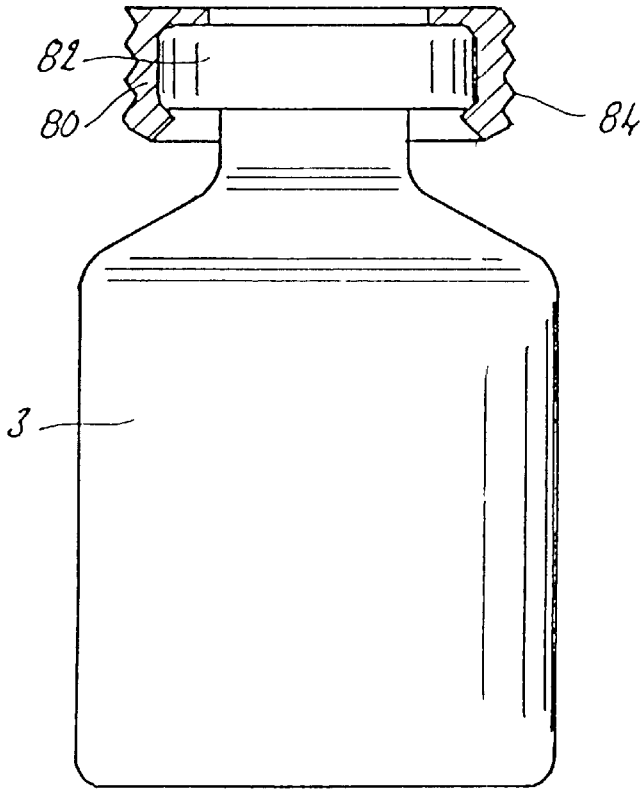

SEALED CONFINEMENT APPLIANCE, FOR DELIVERING A SUBSTANCE

RELATED APPLICATION

The subject patent application is a divisional of U.S. patent application Ser. No. 09/582,020, which was filed on Oct. 2, 2000.

TECHNICAL FIELD

The present invention relates to a leaktight confinement appliance, intended to cooperate with at least one independent receptacle containing a substance, having its own means for transfer into and/or out of the receptacle, and with at least one independent means for delivery of a material.

BACKGROUND OF THE INVENTION

By way of example, the present invention will be introduced and described with reference to the pharmaceutical sector in which it is necessary to connect various receptacles, such as a syringe and a flask, so as to prepare on the spot a medicament, which is then immediately administered to the patient. In this regard, reference will be made in particular to the preparation of a medication solution obtained by dissolving or suspending an active principle in the form of a powder or lyophilisate, subsequently administered in the form of an infusion.

To this end, a leaktight confinement appliance has already been described, in accordance with DE-4 314 090, consisting of a handling chamber, defined by a wall of flexible material, which is substantially leaktight with respect to the external environment.

Arranged inside this chamber there are, respectively:

an independent receptacte containing a liquid or solid substance, having its own means for transfer into and/or out of the receptacle;

another independent receptacle, of the syringe type, containing another substance, for example liquid, likewise having its own means for transfer into and/or out of the other receptacle;

and an independent means for delivery, of the catheter type, for administering to a patient the medication solution which has been obtained by mixing the contents of the two receptacles.

With this appliance, the user connects, first inside the handling chamber, the transfer means of the two receptacles, respectively, so as to bring them into communication, then connects the receptacle, of the syringe type, to the delivery means, of the catheter type.

A disadvantage of the solution described above is that it necessitates packing or overpacking the two receptacles and the delivery means in a single leaktight package. Now, in practice, each one of these different components is often available from different sources or manufacturers so that the solution proposed above does not cover all the cases encountered in practice for administration of a medicament, for example.

SUMMARY OF THE INVENTION

The subject of the present invention is therefore a confinement appliance which is compatible with components (receptacles, for example) from different sources, without first having recourse to overpacking the components.

According to the present invention, the confinement appliance additionally comprises:

a means for leaktight assembly between the handling chamber and the transfer means of the receptacle, in a position of the latter remaining essentially outside the handling chamber, this means occupying a passage through the wall of the handling chamber, and being secured in a leaktight manner on the wall;

and a means for leaktight connection between the handling chamber and the delivery means, in a position in which the latter includes a part outside the chamber, this leaktight connection means occupying another passage through the wall of the handling chamber, and being secured in a leaktight manner on this wall.

BRIEF DESCRIPTION OF THE DRAWINGS

The present invention will be better understood from the following detailed description of a preferred embodiment, accompanied by the attached drawing in which:

FIG. 1 shows a cross-sectional view of the leaktight confinement appliance according to the invention, joined to a receptacle having its own transfer means, of the MONOVIAL® type, as sold by the company BECTON DICKINSON, and to another receptacle also having its own transfer means, of the syringe type, the delivery means of the catheter type remaining outside and not joined to the handling chamber;

FIG. 2 shows a perspective view of the handling chamber of the leaktight confinement appliance according to FIG. 1, before it is joined to either of the receptacles and to the delivery means as defined above;

FIGS. 4 and 5 show, respectively, one of the receptacles with which an appliance according to the invention is intended to cooperate, of the MONOVIAL® type, before its leaktight assembly to the handling chamber, and the manner of joining it to the latter;

FIGS. 6 and 7 show respectively, in a diagrammatic manner, two other embodiments of the present invention.

DETAILED DESCRIPTION OF THE PREFERRED EMBODIMENT

Figure 3:
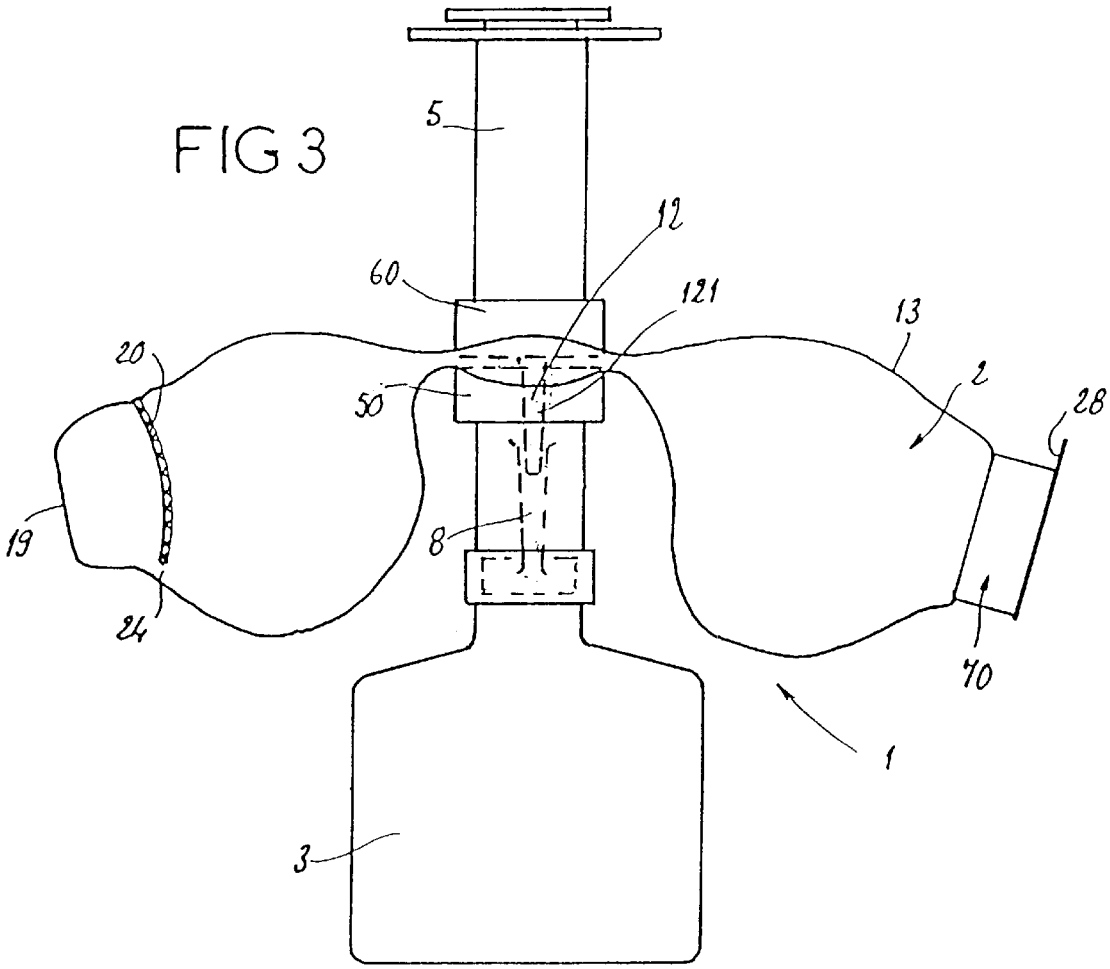
FIG. 3 shows a diagrammatic view of the leaktight confinement appliance shown in FIG. 1, during its handling, more specifically during the leaktight connection of the two aforementioned receptacles, the latter having first been joined to the handling chamber as shown in FIG. 1.

In the preferred embodiment, and as represented in FIGS. 1 to 3, a confinement appliance 1 comprises a handling chamber indicated by reference numeral 2. This appliance is intended to cooperate with pre-existing and independent components, such as are available on the market, namely a first receptacle 3, which may or may not be interchangeable, containing a first substance 4, for example a powder or a lyophilisate, and a second receptacle 5, which may or may not be interchangeable, containing a second substance 6, for example sterile water for injectable preparation.

The first receptacle 3 is, for example, in the form of a medication flask, such as is sold under the brandname MONOVIAL® by the company BECTON DICKINSON, and described by document U.S. Pat. No. 5,487,737 (to which reference will be made as and when necessary) and has its own transfer means 8, including a leaktight connection means 81 in the form of a Luer connector, arranged inside the transfer means 8 of which it forms part.

As is represented more precisely in FIGS. 4 and 5, the receptacle 3 comprises a neck 3*a* on which is crimped the leaktight connection means 81, which includes a shaft 92 closed off by a screw-on cap 91.

After the cap 91 is unscrewed, the shaft can be screwed onto the ring 17, leaktight against the diaphragm 15*a*.

The second receptacle 5 is, for example, in the form of a prefilled syringe including a piston 10 equipped with a plunger 11 (illustrated in broken lines) and has its own transfer means 12 arranged in its proximal part, and including a nose 121 which comprises an axial outlet orifice 121*a*.

It goes without saying that each of the receptacles illustrated in this example can be replaced by another equivalent receptacle, for example a prefilled pouch, and it is even possible to envisage using two receptacles, one of which would be empty. The handling chamber 2 is defined by a wall 13 of flexible and transparent polymer material, for example polyethylene. This wall is leaktight with respect to the external environment. The wall 13 includes three passages 14*a*, 14*b* and 14*c* in which there are respectively secured, leaktight with the wall 13, a means for leaktight assembly 50 to the outer surface of the transfer means 8 of the receptacle 3, another means for leaktight assembly 60 to the outer surface of the transfer means 12 of the receptacle 5, and a means for leaktight connection 70 to a delivery means 71, which will be discussed hereinafter, and consisting of a catheter, for example.

In accordance with the present invention, and according to the claims, the expressions "leaktight assembly means" and "leaktight connection means" will be employed. These expressions, although different for the purposes of the present description, nevertheless designate members or components having an identical or similar function, having in practice the same configuration or structure, or different configurations.

The leaktight assembly means 50 and 60 are secured, respectively, in the orifices 14*a* and 14*b*, being joined by welding or sealing in the wall 13 of flexible material of the handling chamber 2. Each assembly means includes a ring 17 comprising, for example, an internal screw thread 18 adapted to cooperate with the, for example, threaded end 72 of the transfer means 8 of the receptacle 3, or the threaded end 73 of the transfer means 12 of the receptacle 5.

As FIG. 1 shows clearly, the means for assembly 50 and 60 by screwing ensure leaktightness between the handling chamber 2 and the outer surface of the transfer means 8 and 12, respectively. In the assembled position according to FIG. 1, the receptacles 3 and 5 remain essentially outside the handling chamber 2. "Outer surface" denotes the solid surface of each transfer means, excluding that surface or those surfaces of the passage into and/or out of the means.

Each ring 17 of each leaktight assembly means 50 or 60 delimits a passage into and/or out of the handling chamber 2 and includes a leaktight closure means 15*a* or 15*b*, when the transfer means 8 or 12 is not joined to the assembly means 50 or 60, and thus does not occupy the whole of the passage. Each leaktight closure means consists of a diaphragm 15*a* or 15*b* of elastomer, for example rubber, for example preslit, or having an incipient break line, for example a nontraversing slit.

Moreover, as is shown in FIG. 1, the cross section of the passage in each ring 17 is adapted in shape and dimensions to those of the proximal part of the transfer means 8 or 12.

The receptacles 3, 5 have been shown in relation to orifices 14*a* and 14*b* situated opposite each other, but this is not mandatory since the casing 13 is flexible, and it is thus easy to envisage an arrangement in which the two orifices 14*a* and 14*b* are no longer opposite each other.

The handling chamber 2 also includes a supplementary pouch 19 defined, for example, by a partition 20 between two opposite surfaces of the casing 13 of flexible polymer material, and, for example, in the shape of an arc of a circle. The pouch 19 contains an interconnection appliance 21 consisting of a nipple 22, for example fitting on the transfer means 12, in this case on the nose 121 of the receptacle 5, and a penetration tube 23, for example intended to pass through the diaphragm 15*c*, so as to cooperate in a leaktight manner with the delivery means 71 by way of the cover 15*c*. This tube 23 is designed in such a way that it cannot perforate the casing 13. Generally, neither the chamber nor the receptacles include sharp or pointed objects capable of piercing the casing 13. Such an interconnection appliance of the type described is available from the company BAXTER and sold under the brandname INTERLINK®. The partition 20 closes the pouch 19 in such a way as to leave a passage 24 through which it is possible to free the interconnection appliance 21 in the casing 13 by maneuvering it manually.

Moreover, the leaktight connection means 70 is intended to cooperate with an independent means 71 for delivery of a material, for example a catheter for infusing or injecting into the patient a liquid medication substance which has been obtained, for example, by mixing a medicament in lyophilized form in the receptacle 3 and sterile water in the receptacle 5.

This leaktight connection means 70 generally has the same structure and the same function as each leaktight assembly means 50 or 60 described above, in that it consists of a ring 26 welded or sealed into the wall 13, equipped with an annular external rib 27. However, it differs from each means 50 or 60 especially in that it also establishes a leaktight connection between the handling chamber 2 and the outer surface of the delivery means 71, in a position in which the latter includes a part outside the chamber 2, and in that it occupies the passage 14*c* through the wall 13 of the chamber 2, being secured in a leaktight manner on the latter.

As before, the leaktight connection means 70 and more precisely the ling 26 delimit a passage into and/or out of the handling chamber 2; and a means for leaktight closure of this passage, in this case a cover 15*c*, occludes the passage when the delivery means 71 is not joined, directly or indirectly, to the transfer means 70.

The passage in the leaktight connection means 70 is closed both by the cover 15*c*, which can consist of the same material as that of the diaphragms 15*a* and 15*b*, and which is placed in line with the rib 27, and also by a peel-off sterility and safety film 28, for example of aluminum or polyethylene, or a complex material. The leaktight connection means 70 additionally includes an active barrier 29 through the aforementioned passage. This barrier 29 acts positively with respect to the substance or substances contained in the receptacles 3, 5 or generated during the handling in the chamber 2, by countering the effects of these substances, for example by adsorption, neutralizing, chemical or biochemical reaction, or with respect to contaminants external to the chamber. Moreover, the diaphragms 15*a*, 15*b* can also be equipped with such active barriers. In the embodiment illustrated in FIGS. 1 to 3, the active barrier 29 is a supplementary diaphragm to, or a covering applied on, the diaphragm 15*c*, but it can also be integrated or incorporated in this diaphragm, for example during manufacture of the latter. By way of example, if the receptacles contain substances harmful to the human organism, for example bacteria, the active barrier can be an antibacterial filter.

The functioning of the leaktight confinement appliance will now be described briefly, in particular with reference to FIG. 3. This digrammatic figure shows the bringing together of the receptacles 3, 5, which is made possible by the flexibility of the material forming the wall 13 of the chamber 2. The two receptacles 3, 5 are joined in a leaktight manner to the chamber 2 by the assembly means 50 and 60, respectively, then their respective transfer means 8 and 12 are connected to one another, either directly or by way of the interconnection means 21. This makes it possible to establish a direct communication between the inside of the receptacle 3 and the inside of the receptacle 5, within the chamber 2, and isolated from the external environment; cf. FIG. 3. This permits the handling of substances without involuntary or accidental leakage to the external environment. Once the handling has been completed, the material thus prepared is transferred to the outside, or to another system, still in a leaktight manner with respect to the external environment, by virtue of the leaktight connection means 70, by removing the peel-off film 28, introducing the free end of the catheter 71 (or delivery means) in a leaktight manner through the cover 15*c* and the barrier 29, and connecting this end for example to the transfer means 12 of the receptacle 5, via the interconnection appliance, still inside the chamber 2, and thus isolated from the external environment.

In accordance with FIG. 6, another embodiment of the invention is adapted to a traditional receptacle of the "vial" type, that is to say including an elastomeric stopper, with a metal capsule 82 engaged around it.

The ring 17 of the assembly means 50 includes teeth 17*a* which are able to snap under the ring 82, while the corresponding diaphragm 15*a* includes a circular sealing lip 15*g* against the capsule 82.

The transfer means 8 is separate and arranged in the pouch 19 and it incorporates a perforator point for perforating the stopper of the receptacle.

The embodiment according to FIG. 7 differs from that shown in FIG. 6 in that the joining means is in two parts, one consisting of the ring 17, for example with internal thread 73, and the other consisting of another ring 80, which can be snapped onto the capsule 82, and for example with an external thread 84, so as to be screwed into the thread 73 and come to bear in a leaktight manner against the lip 15*g*.

An appliance according to the present invention is not limited to use in hospitals or doctors' surgeries for leaktight confinement and handling of substances harmful to the human organism or the environment. It also has an application in other industrial sectors where it is necessary to confine a substance in an absolute manner with respect to its environment, while permitting free handling of this substance, for example in the field of powder materials of high value, in particular diamond powders or powders of other precious stones, or else in the field of manufacture of electronic components.

Moreover, given that when all the handling and transfer operations have been completed, all the components presenting a possible risk to the user are connected in a leaktight manner to the handling chamber, an additional advantage of the appliance according to the invention is the possibility of conveying it safely to the recovery or destruction site. The appliance can then be designed for one-off use.

The terms "leaktight" and "leaktightness" are intended to signify the relative characteristic according to which at least one reference substance, called contaminant (for example a microorganism, or biologically active material), is in a much smaller quantity, even a negligible quantity, inside an enclosed space than it is outside (for example, the environment), or vice versa.

What is claimed is:

1. A confinement appliance adapted to be used with a first receptacle containing a first substance, a second receptacle containing a second substance, and an interconnection device which transfers at least a portion of the first and second substances to an external environment outside of said appliance, said appliance comprising:

a handling chamber defined by a wall of flexible material for creating a substantially leaktight cavity with respect to the external environment, said handling chamber having at least a first passage and a second passage formed within said wall of flexible material;

a first leaktight assembly mounted to said handling chamber and being secured in a leaktight manner on said wall about said first passage, whereby said first leaktight assembly provides selective access through said first passage and into said cavity by the first receptacle;

a second leaktight assembly mounted to said handling chamber and being secured in a leaktight manner on said wall about said second passage, whereby said second leaktight assembly provides selective access through said second passage and into said cavity by at least one of the first and second receptacles such that the first receptacle connects to the second receptacle by at least partially collapsing said handling chamber for introducing the first substance of the first receptacle to the second substance of the second receptacle; and a pouch formed within said wall of said handling chamber for selectively retaining the interconnection device, whereby the interconnection device can be removed from said pouch and connected to one of the first and second receptacles for delivering at least one of the first and second substances to the external environment.

2. The appliance according to claim 1 further including a partition formed within said handling chamber to define said pouch and separate said pouch from said cavity.

3. The appliance according to claim 2 wherein said partition defines a passage between said pouch and said cavity for allowing removal of the interconnection device from said pouch.

4. The appliance according to claim 2 wherein said wall of flexible material includes opposing surfaces with a portion of said opposing surfaces being adhered together to form said partition.

5. The appliance according to claim 2 wherein said partition is in the shape of an arc of a circle.

6. The appliance according to claim 1 wherein said handling chamber further includes a delivery passage formed within said wall of flexible material.

7. The appliance according to claim 6 further including a leaktight connector mounted to said handling chamber and being secured in a leaktight manner on said wall about said delivery passage, whereby said leaktight connector provides selective access through said delivery passage such that at least one of the first and second substances can be delivered to a delivery device.

8. The appliance according to claim 7 wherein said first and second leaktight assemblies and said leaktight connector each include an elastomer diaphragm.

9. The appliance according to claim 8 wherein each of said first and second leaktight assemblies include a mounting ring with said elastomer diaphragm disposed within said ring.

10. The appliance according to claim 1 wherein said first and second passages and said first and second leaktight assemblies are arranged opposite each other in a handling position of said wall forming said handling chamber.

11. The appliance according to claim 1 wherein said wall of said handling chamber is leaktight to contamination by microorganisms and a biologically active material.

12. A confinement appliance adapted to be used with a first receptacle containing a first substance and a second receptacle containing a second substance, said appliance comprising:

a handling chamber defined by a wall of flexible material for creating a substantially leaktight cavity with respect to an external environment, said handling chamber having at least a first passage and a second passage formed within said wall of flexible material;

a first leaktight assembly mounted to said handling chamber and being secured in a leaktight manner on said wall about said first passage, whereby said first leaktight assembly provides selective access through said first passage and into said cavity by the first receptacle;

a second leaktight assembly mounted to said handling chamber and being secured in a leaktight manner on said wall about said second passage, whereby said second leaktight assembly provides selective access through said second passage and into said cavity by at least one of the first and second receptacles such that the first receptacle connects to the second receptacle by at least partially collapsing said handling chamber for introducing the first substance of the first receptacle to the second substance of the second receptacle;

an interconnection device disposed within said handling chamber for transferring at least a portion of the first and second substances to the external environment; and a pouch formed within said wall of said handling chamber with said pouch selectively retaining said interconnection device, whereby said interconnection device can be removed from said pouch and connected to one of the first and second receptacles for delivering at least one of the first and second substances to the external environment.

13. The appliance according to claim 12 further including a partition formed within said handling chamber to define said pouch and separate said pouch from said cavity.

14. The appliance according to claim 13 wherein said partition defines a passage between said pouch and said cavity for allowing said removal of said interconnection device from said pouch.

15. The appliance according to claim 13 wherein said wall of flexible material includes opposing surfaces with a portion of said opposing surfaces being adhered together to form said partition.

16. The appliance according to claim 12 wherein said interconnection device includes a mounting portion and a penetration portion.

17. The appliance according to claim 12 further including a transfer device disposed within said pouch.

18. The appliance according to claim 17 wherein said transfer device includes a mounting portion and a perforation portion.

19. The appliance according to claim 12 wherein said handling chamber further includes a delivery passage formed within said wall of flexible material.

20. The appliance according to claim 19 further including a leaktight connector mounted to said handling chamber and being secured in a leaktight manner on said wall about said delivery passage, whereby said leaktight connector provides selective access through said delivery passage such that at least one of the first and second substances can be delivered to a delivery device.

* * * * *